US006090226A

United States Patent [19]

Hasegawa et al.

[11] Patent Number: 6,090,226

[45] Date of Patent: Jul. 18, 2000

[54] STEEL PLATE EXCELLENT IN BRITTLE CRACK PROPAGATION ARREST CHARACTERISTICS AND LOW TEMPERATURE TOUGHNESS AND PROCESS FOR PRODUCING SAME

[75] Inventors: Toshiei Hasegawa; Tadashi Ishikawa; Yuji Nomiyama, all of Oita, Japan

[73] Assignee: Nippon Steel Corporation, Tokyo, Japan

[21] Appl. No.: 08/553,307

[22] PCT Filed: Mar. 29, 1995

[86] PCT No.: PCT/JP95/00602

§ 371 Date: Nov. 21, 1995

§ 102(e) Date: Nov. 21, 1995

[87] PCT Pub. No.: WO95/26424

PCT Pub. Date: Oct. 5, 1995

[30] Foreign Application Priority Data

Mar. 29, 1994 [JP] Japan ..... 6-059554
Jan. 5, 1995 [JP] Japan ..... 7-000399

[51] Int. Cl.[7] ..... C21C 8/02; C22C 38/06; C22C 38/14

[52] U.S. Cl. ..... 148/320; 148/654

[58] Field of Search ..... 148/654, 320

[56] References Cited

U.S. PATENT DOCUMENTS 5,326,527 7/1994 Bodnar et al. .

FOREIGN PATENT DOCUMENTS 61-235534 10/1986 Japan .
4-141517 5/1992 Japan .
5-271860 10/1993 Japan .
5-271861 10/1993 Japan .
5-271862 10/1993 Japan .
5-295431 11/1993 Japan .
5-295432 11/1993 Japan .
2289057 11/1995 United Kingdom .

OTHER PUBLICATIONS

Patent Abstracts of Japan, vol. 16, No. 413 (C–0980), Sep. 2, 1992.

*Primary Examiner*—Deborah Yee
*Attorney, Agent, or Firm*—Kenyon & Kenyon

[57] ABSTRACT

The present invention relates to a process for producing a structural steel plate, which process greatly improves the excellent brittle crack propagation arrest characteristics and Charpy characteristics at the same time without relying on the addition of costly alloying elements such as Ni. The steel plate is characterized in that the steel plate comprises, based on weight, 0.04 to 0.30% of C, up to 0.5% of Si, up to 2.0% of Mn, up to 0.1% of Al, 0.001 to 0.10% of Ti, 0.001 to 0.01% of N and the balance Fe and unavoidable impurities, that the structure in the front surface region and the back surface region each having a thickness corresponding to 2 to 33% of the plate thickness has an average grain size d of up to 3 μm, and that the structure has a controlled Vickers hardness.

6 Claims, 5 Drawing Sheets

10μm

STEEL PLATE EXCELLENT IN BRITTLE CRACK PROPAGATION ARREST CHARACTERISTICS AND LOW TEMPERATURE TOUGHNESS AND PROCESS FOR PRODUCING SAME

FIELD OF THE INVENTION

The present invention relates to a structural steel plate which exhibits greatly improved excellent brittle crack propagation arrest characteristics and, at the same time, greatly improved Charpy characteristics without relying on the addition of costly alloying elements such as Ni and a process for producing the same.

BACKGROUND OF THE INVENTION

Grain refining and increasing the Ni content are the principal metallurgical methods for improving the brittle crack propagation arrest characteristics of a steel plate. Increasing the Ni content is a method for improving the brittle crack propagation arrest characteristics without relying on the microstructure, but the method naturally brings about an increase in the cost. Accordingly, grain refining by devising a production process is preferred. It is concluded from the brittle crack propagation-arrest behaviors of steel plates as a whole that what actually contributes greatly to the improvement of the brittle crack propagation arrest characteristics is a plastic deformation region termed a shear rip formed in the surface layer portions of the steel plate during brittle crack propagation, and that when the shear rip is formed, the ability of the steel plate for absorbing the propagation energy that the brittle crack has is increased and the brittle crack propagation arrest characteristics are greatly improved. The formation of the shear rip is achieved by grain refining.

Accordingly, various attempts have heretofore been made to improve the brittle fracture propagation arrest characteristics by grain refining. In general, grain refining is effected by increasing the degree of controlled. rolling in hot rolling, or adding Nb to further facilitate controlled rolling. However, increasing the degree of controlled rolling brings about lowered productivity, and adding Nb is likely to result in the deterioration of toughness in a weld zone. Moreover, significant grain refining cannot be expected by these methods, and the effect of improving the brittle crack propagation arrest characteristics thus obtained is small. Recently, for example, Japanese Patent Publication Kokai No. 61-235534 proposes a process for producing a steel plate exhibiting a Kca value, which represents a brittle crack propagation arrest characteristics at −20° C. by ESSO test, of about 460 to 960 $kgf \cdot mm^{-3/2}$, by cooling the steel slab from the surface to a distance corresponding to at least ⅛ of the slab thickness in the central part at temperatures up to $Ar_3$ transformation temperature, starting rolling while the temperature difference is maintained in the thickness direction of the steel slab, and recuperating the steel to temperatures of at least the $Ac_3$ transformation temperature in the entire region of the steel slab thickness during rolling or after rolling.

Accordingly, steel products are required to have higher brittle crack propagation arrest characteristics as the structures now tend to be used in harsher environments. The characteristics of a steel plate attained by the process mentioned above, therefore, may not always be satisfactory. In the process of Japanese Patent Publication Kokai No. 61-235534, the entire region of the steel slab is simply recuperated to temperatures of at least the $AC_3$ transformation temperature, and the α-grain size finally obtained by γ-α transformation is about 5 μm at the least. Accordingly, a new technique is required to further improving the brittle crack propagation arrest characteristics.

There has been proposed, very recently, a process wherein the surface layer portions of a steel are cooled and then subjected to significant grain refining by rolling during recuperation to improve the brittle crack propagation arrest characteristics, as disclosed in Japanese Patent Publication Kokai No. 4-141517. According to the process, the surface layer portions are made to have ultrafine grains on the average, and a shear rip is formed therein, whereby excellent brittle crack propagation arrest characteristics are achieved even at −50° C. However, since ultrafine grains are formed principally by work recrystallization of ferrite during recuperation, there has been found a problem in that a structure and a steel material with nonuniformity are likely to be formed due to a delicate variation of the heat cycle. Although the surface layer portions of the steel plate have come to have a grain size of 3 μm level, which level is as fine as about ⅓ to 1/10 of the grain size level of conventional steel plates, complete prevention of brittle fracture cannot be attained in a certain temperature range where the steel plate is used. A very good toughening technique is newly required in addition to mere grain refining.

DISCLOSURE OF THE INVENTION

The present invention has paid attention to the fact that the brittle fracture can be described in relation to the yield stress and the microscopic fracture stress of materials, and the brittle fracture phenomenon has been investigated and elucidated in detail. As a result, the present invention has changed the conventional opinion that when the grain size is reduced to obtain fine grains, the yield stress is increased in accordance with the Hall-Petch relationship, and that as a result, a great deal of improvement of the brittle fracture-resistant characteristics cannot be achieved even when the microscopic fracture stress is increased by grain refining. The present invention thus provides a steel plate having improved brittle fracture-resistant characteristics by forming crystal grain sizes which are effective in improving the microscopic fracture stress and not effective in increasing the yield stress.

Concretely, in the recrystallization of ferrite, the grain size of the previous structure can be made sufficiently fine by controlling rough rolling conditions, and recrystallization of ferrite by rolling during the subsequent temperature rise is made to proceed sufficiently. As a result, the state of dislocations in grain boundaries formed by the recrystallization can be controlled, and grain boundaries which are not effective in increasing the yield stress but which are effective in increasing the microscopic fracture stress can be formed. The present invention is intended to provide a steel plate comprising a structure, which greatly improves the brittle fracture-resistant characteristics, in the surface layer portions thereof.

In the process for improving the brittle fracture propagation arrest characteristics, as disclosed in Japanese Patent Publication Kokai No. 4-141517 among the prior techniques mentioned above, wherein the surface layer portions of a steel plate are cooled and the steel plate is rolled during recuperation to make surface portion grains significantly fine and improve the brittle fracture propagation arrest characteristics, the ultrafine grain structure therein has been examined in detail in the present invention. As a result, it has been discovered that there is a limitation on the improvement of the brittle fracture-resistant characteristics which can be obtained by only making the grains ultrafine as disclosed in Japanese Patent Publication Kokai No. 4-141517, and the present invention has thus been achieved.

That is, although the brittle fracture-resistant characteristics are improved when the grain size is reduced due to an increase in the critical microscopic brittle fracture stress caused by making the grains ultrafine, it has been confirmed that there is a limitation on the improvement of the brittle fracture-resistant characteristic due to a difficulty in plastic deformation at a crack tip caused by an increase in the yield strength in accordance with ultrafine grain formation.

The present inventors have, therefore, analyzed, in further detail, the boundaries of the grains which have been made ultrafine, and discovered that there are various types of grain boundaries and that the relationship between a grain size and a yield strength which shows plastic deformability differs depending on the properties of grain boundaries. That is, it is known that in ferrite grains formed by ordinary austenite/ferrite transformation, there holds the Hall-Petch relationship between the grain size and a yield stress showing the deformability thereof. However, grain boundaries which are formed not by austenite/ferrite transformation but by work recrystallization are formed by the rearrangement of dislocations, and have exhibited a relationship between a grain size and a yield stress which is different from that exhibited by the grain boundaries formed by austenite/ferrite transformation. Moreover, it has been found, as the result of observing a fracture obtained by brittle fracture, that the fracture unit becomes fine in accordance with the grain size and the microscopic fracture stress is increased.

The microscopic fracture stress is known to be related to the magnitude of the brittle secondary phase structures of carbides, etc. Since there is generally a positive correlation between grain size and the brittle secondary phase structure, the microscopic fracture stress increases when the grains are made fine.

Since ultrafine grain formation by recrystallization of ferrite is also accompanied by making the brittle secondary phase structure fine and, in addition, the grain boundaries are formed by rearrangement of dislocations, the slip directions of adjacent grains are close to each other, and the degree of slip hindrance caused by the grain boundaries becomes less than that caused by those formed by ordinary austenite/ferrite transformation. As a result, it has become possible to form grain boundaries which can inhibit an increase in the yield stress while increasing the microscopic fracture stress.

The characteristics of the grain boundaries as described above can be obtained by observing dislocations with a TEM and examining, in detail, grain orientations, etc. However, these procedures are very complicated, and involve industrial problems.

Accordingly, the present inventors have devised a method for industrially evaluating the characteristics of grain boundaries.

The present inventors have examined the degree of deviation of the relationship between a grain size and a yield stress from the relationship therebetween of ordinary grains formed by austenite/ferrite transformation through utilization of the change of the relationship therebetween caused by the characteristics of the grain boundaries. As a result, they have devised parameters showing the characteristics of the grain boundaries which improve the microscopic fracture stress and inhibit an increase in the yield stress.

Since the yield stress is a value showing the ability for transmitting the deformation of grain boundaries, it can be evaluated by measuring the hardness through forming an indent larger than the grain size.

On the other hand, measuring a grain size is important in the present invention. Since not only grain boundaries formed by ordinary austenite/ferrite transformation but also grain boundaries formed by work recrystallization are treated in the present invention, manifestation of grain boundaries with a conventional nital etchant is insufficient. The present inventors have found that a Marshall reagent, an etchant mainly containing aqueous oxalic acid, aqueous hydrogen peroxide and aqueous sulfuric acid, is suitable for manifesting clear grain boundaries even in a worked structure. The size of grains manifested by etching with the reagent has been measured.

There has been obtained the result that a structure significantly excellent in brittle fracture-resistant characteristics satisfies the expression (1), by using such an evaluation method:

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn %, are percent by weight of C, Si and Mn, respectively), or $$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

The expression is based on a difference among dislocation structures of grain boundaries, and the characteristics of extremely complicated grain boundaries are represented by the relationship between a hardness and a grain size, as macroscopic characteristics.

A structure having such grain boundaries becomes excellent in its brittle fracture-resistant properties. However, when the structure has significantly excellent properties industrially compared with conventional steel structures, the grains of the structure are made ultrafine. The present inventors have found that the structure satisfying the expression (1) or (2) is extremely excellent in brittle fracture-resistant characteristics when the grain size is up to 3 $\mu$m.

The structure of the invention is formed not by conventional transformation from an austenite structure to a ferrite one but by introducing a large amount of dislocations into a ferrite structure and directly recovery-recrystallizing the ferrite structure to form grain boundaries. The predetermined structure of the invention can be obtained by the process as described below.

In addition, the method for manifesting grain boundaries with a Marshall reagent is illustrated below.

The Marshall reagent is an etchant mainly containing an aqueous solution of oxalic acid, aqueous hydrogen peroxide and sulfuric acid, and usually comprises 50 ml of an aqueous solution containing 8% of oxalic acid, 50 ml of aqueous hydrogen peroxide and 7 ml of 50% sulfuric acid.

A sample is first immersed in 5% hydrochloric acid for 3 to 4 sec, washed with water, dried, etched at room temperature for 3 to 5 sec with the Marshall reagent mainly containing an aqueous solution of oxalic acid, aqueous hydrogen peroxide and aqueous sulfuric acid, washed with water, and dried to manifest grain boundaries. The etching method is a typical example. Even when the composition of the etchant is somewhat varied, grain boundaries to be observed are etched and manifested though observation of grain boundaries becomes difficult. The etching method is, therefore, in the applicable range of the present invention.

The subject matter of the present invention is as described below.

(1) A steel plate excellent in brittle crack propagation arrest properties and low temperature toughness comprising, based on weight, 0.04 to 0.30% of C, up to 0.5% of Si, up to 2.0% of Mn, up to 0.1% of Al, 0.001 to 0.10% of Ti, 0.001 to 0.01% of N and the balance Fe and unavoidable impurities, the average grain size d of the structure in the front surface layer region and the back surface layer region each having a thickness corresponding from 2 to 33% of the plate thickness being up to 3 μm, and the Vickers hardness of the structure satisfying the following expression (1):

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn % are percent by weight of C, Si and Mn, respectively).

(2) A steel plate excellent in brittle crack propagation arrest properties and low temperature toughness comprising, based on weight, 0.04 to 0.30% of C, up to 0.5% of Si, up to 2.0% of Mn, up to 0.1% of Al, 0.001 to 0.10% of Ti, 0.001 to 0.01% of N, one or at least two elements selected from the following group in the following contents: up to 0.5% of Cr, up to 1.0% of Ni, up to 0.5% of Mo, up to 0.1% of V, up to 0.05% of Nb, up to 0.0015% of B and up to 1.5% of Cu, and the balance Fe and unavoidable impurities, the average grain size d of the structure in the front surface layer region and the back surface layer region each having a thickness corresponding from 2 to 33% of the plate thickness being up to 3 μm, and the Vickers hardness of said structure satisfying the following expression (2):

$$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

(3) A process for producing a steel plate excellent in brittle crack propagation arrest properties and low temperature toughness comprising the steps of heating a steel slab comprising, based on weight, 0.04 to 0.30% of C, up to 0.5% of Si, up to 2.0% of Mn, up to 0.1% of Al, 0.001 to 0.10% of Ti, 0.001 to 0.01% of N and the balance Fe and unavoidable impurities to temperatures of at least $Ac_3$ transformation temperature and up to 1,150° C., rolling the heated slab so that the cumulative draft at temperatures up to 950° C. becomes from 10 to 50%, carrying out at least once a procedure comprising starting cooling the front surface layer region and the back surface layer region each having a thickness corresponding to 2 to 33% of the plate thickness at this stage at a rate of at least 2° C./sec from temperature of at least the $Ar_3$ transformation temperature, and stopping cooling at temperatures up to the $Ar_3$ transformation temperature so that the steel plate recuperates, finishing finish rolling during the period from the completion of the final cooling to the end of the recuperation in the above step by rolling the steel plate so that at least 30% of a draft is imparted thereto while the structure of the steel plate contains reversely transformed or non-transformed austenite in a fraction of less than 50%, recuperating the front and the back surface layer regions of the thus finish rolled steel plate to temperatures of less than $Ac_3$ transformation temperature, and cooling the steel plate, the average grain size d of the structure in the front surface layer region and the back surface layer region each having a thickness corresponding to 2 to 33% of the resulting steel plate being up to 3 μm, and the Vickers hardness of the structure satisfying the following expression (1):

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn % are percent by weight of C, Si and Mn, respectively).

(4) A process for producing a steel plate excellent in brittle crack propagation arrest properties and low temperature toughness comprising the steps of heating a steel slab comprising, based on weight, 0.04 to 0.30% of C, up to 0.5% of Si, up to 2.0% of Mn, up to 0.1% of Al, 0.001 to 0.10% of Ti, 0.001 to 0.01% of N, one or at least two elements selected from the following group in the following contents: up to 0.5% of Cr, up to 1.0% of Ni, up to 0.5% of Mo, up to 0.1% of V, up to 0.05% of Nb, up to 0.0015% of B and up to 1.5% of Cu, and the balance Fe and unavoidable impurities to temperatures of at least the $Ac_3$ transformation temperature and up to 1,150° C., rolling the heated slab so that the cumulative draft at temperatures up to 950° C. becomes from 10 to 50%, carrying out at least once a procedure comprising starting cooling the front surface layer region and the back surface layer region each having a thickness corresponding to 2 to 33% of the plate thickness at this stage at a rate of at least 2° C./sec from a temperature of at least the $Ar_3$ transformation temperature, and stopping cooling at temperatures up to the $Ar_3$ transformation temperature so that the steel plate recuperates, finishing finish rolling during the period from the completion of the final cooling to the end of the recuperation in the above step by rolling the steel plate so that at least 30% of a draft is imparted thereto while the structure of the steel plate contains reversely transformed or non-transformed austenite in a fraction of less than 50%, recuperating the front and the back surface layer regions of the thus finish rolled steel plate to temperatures of less than the $Ac_3$ transformation temperature, and cooling the steel plate, the average grain size d of the structure in the front surface layer region and the back surface layer region each having a thickness corresponding to 2 to 33% of the resulting steel plate being up to 3 μm, and the Vickers hardness of the structure satisfying the following expression (1):

$$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

(5) The process for producing a steel plate excellent in brittle crack propagation arrest properties and low temperature toughness according to claim 3 or 4, wherein the steel plate whose front and back surface layer regions have been recuperated to temperatures of less than the $Ac_3$ transformation temperature subsequent to completion of the finish rolling is cooled to temperatures up to 650° C. at a rate up to 60° C./sec.

(6) The process for producing a steel plate excellent in brittle crack propagation arrest properties and low temperature toughness according to claim 3 or 4, wherein the steel plate whose front and back surface layer regions have been recuperated to temperatures of less than the $Ac_3$ transformation temperature subsequent to completion of the finish rolling is cooled to temperatures up to 650° C. at a rate of up to 60° C./sec, and the steel plate is tempered at temperatures up to $Ac_1$ transformation temperature.

EMBODIMENTS OF THE INVENTION

The relationship between a grain size and fracture-resistant characteristics has been investigated while the method for forming grain boundaries is variously changed. There will be explained a difference of fracture-resistant characteristics between a steel plate having grain boundaries according to the present invention and a steel plate having ordinary grain boundaries.

Grain boundaries were formed as described below. A ferrite structure (A) was formed by conventionally utilized $\gamma/\alpha$ transformation. A ferrite structure (B) was formed by heating a ferrite structure the grains of which had been made sufficiently fine while a large amount of dislocations were being introduced through working, whereby the ferrite structure was recovery recrystallized to directly make the structure fine. The grain size, hardness and fracture-resistant characteristics of a structure manifested by etching with the Marshall reagent mentioned above, in the ferrite structures (A) and (B) were examined. The fracture-resistant characteristics were evaluated by NRL drop weight test.

Figure 1:
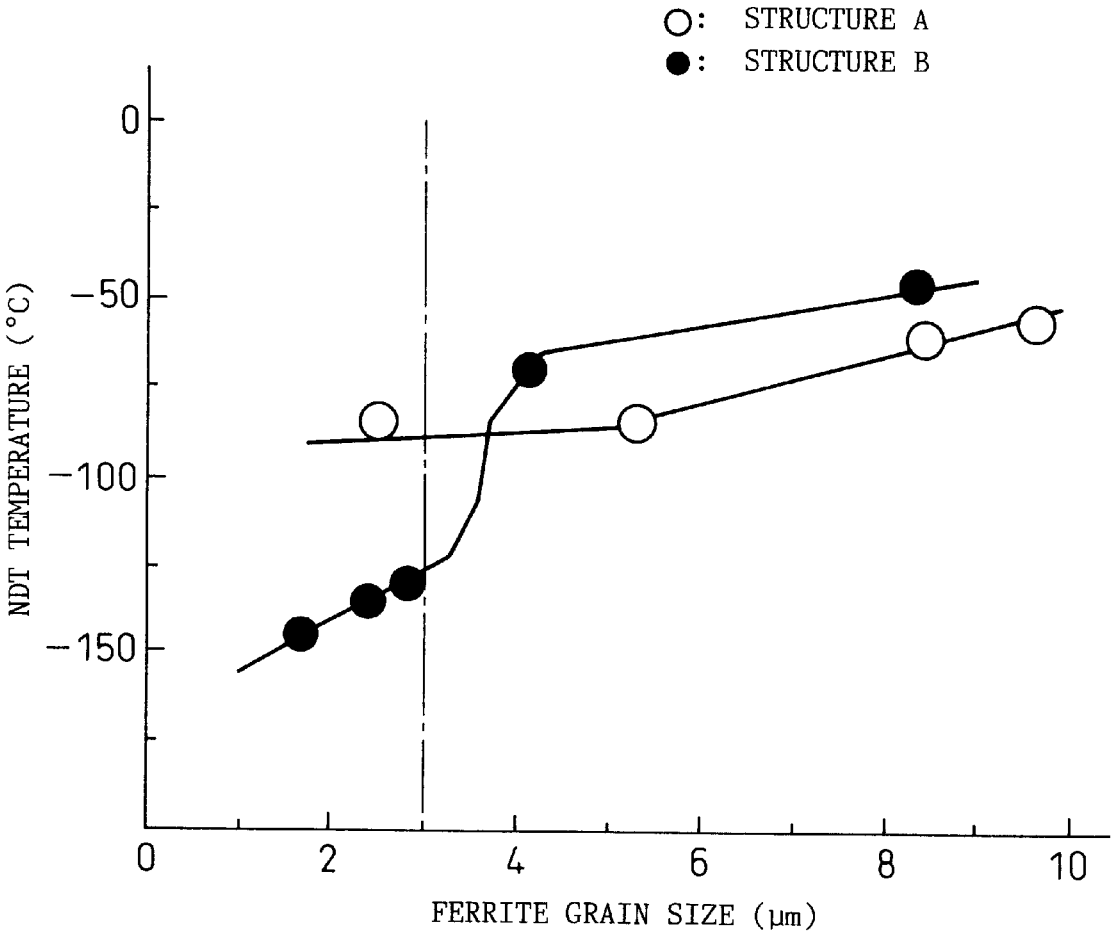
FIG. 1 is a graph showing the relationship between a NDT temperature and a ferrite grain size.
Figure 2:
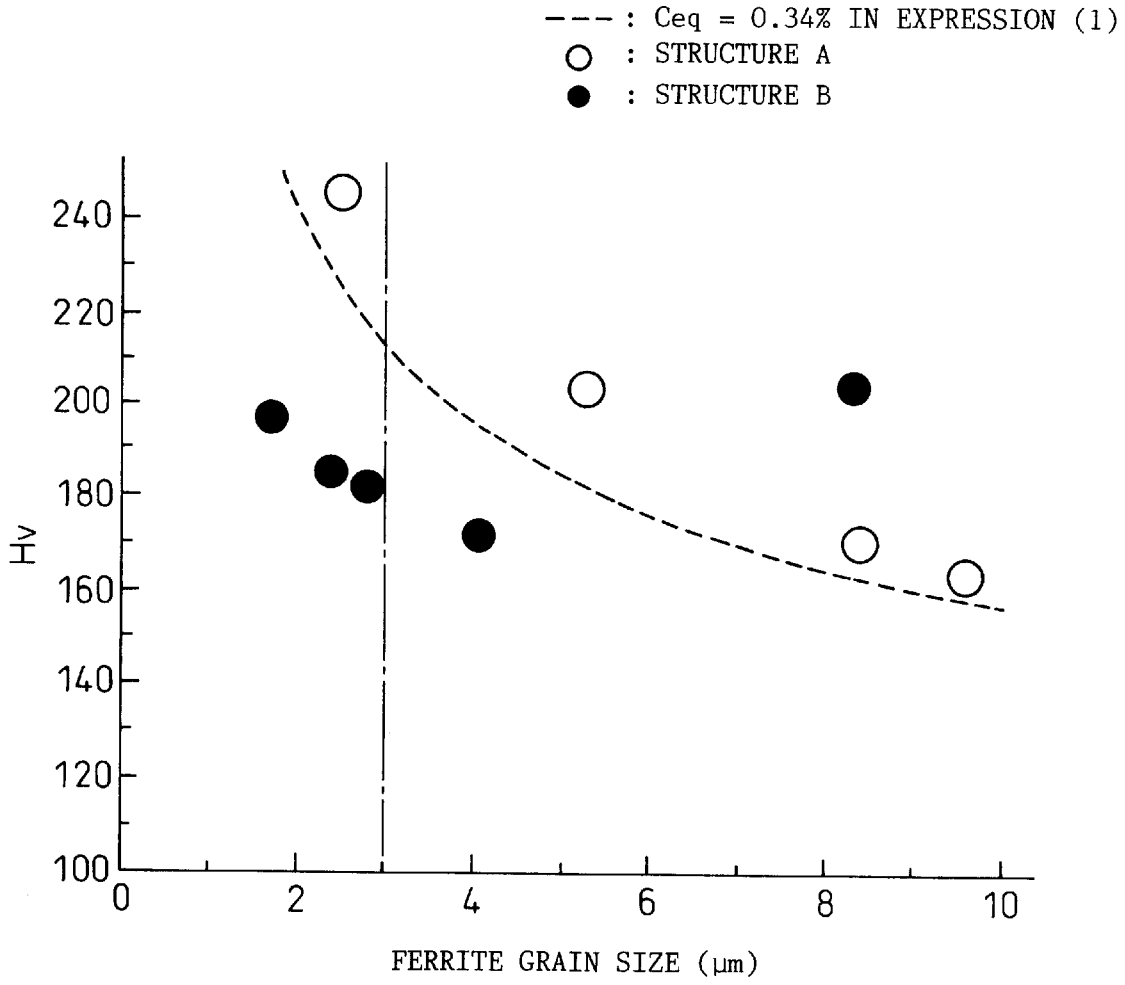
FIG. 2 is a graph showing the relationship between Hv and a ferrite grain size.

The results are shown in FIG. 1 and FIG. 2. FIG. 1 is a graph showing the relationship between a ferrite grain size ($\mu$m) and a NDT temperature (°C.). FIG. 2 is a graph showing the relationship between a ferrite grain size ($\mu$m) and Hv when steel with Ceq being equal to 0.34% was used. It is seen from these figures that the structure (B) has a hardness lower than the structure (A) having the same grain size. The results show that the structure (B) is more likely to be plastically deformed when suffered deformation than the structure (A) though both structures have the same grain size. That is, the structure (B) having a crack is plastically deformed before the stress at the crack tip reaches a microscopic fracture stress. As a result, the structure (B) does not suffer brittle fracture, and the NDT temperature is shifted to the low temperature side.

That is, it can be concluded as follows: the structure (B) has such characteristic grain boundaries that the structure (B) tends to yield even when the grains are made ultrafine; and the difference in the fracture-resistant characteristics between the steel plate of the invention and a conventional one can be described from the relationship between a hardness and a grain size.

As the result of conducting similar experiments on steel plates having various chemical compositions, it has been discovered that a structure which is manifested by etching with a Marshall reagent and for which the expression (1) mentioned below holds with regard to the grain size and Vickers hardness Hv is excellent in fracture-resistant characteristics compared with a conventional structure formed by $\gamma/\alpha$ transformation.

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn % are percent by weight of C, Si and Mn, respectively).

$$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

The most important requirement in the present invention is to ensure predetermined grain boundary characteristics. To meet the requirement, it is necessary that the grain boundary formation by recrystallization of ferrite be ensured in an optimum situation.

Although Japanese Patent Publication Kokai No. 4-141517 discloses a method for forming ultrafine grains by recrystallizing ferrite, not only making ferrite grains ultrafine but also ensuring predetermined properties of grain boundaries are required in the present invention. The disclosure of the patent publication is, therefore, insufficient.

As the result of investigating in detail the process of forming grain boundaries, the present inventors have discovered that in the recrystallization of ferrite in the heating step, the grain size of the previous structure is extremely important to subsequent grain boundary formation.

There will be explained the details of finding the rough rolling conditions in the present invention of ensuring the grain size in the previous structure.

Firstly, the necessity of rough rolling will be explained.

It is necessary first to make the heated austenite grains of a steel slab prior to hot rolling sufficiently fine. In the present invention, the austenite grains are made fine by defining the contents of Ti and N and utilizing the pinning effects of the austenite grains through dispersion of TiN during heating and by restricting the heating temperature of the steel slab to up to 1,150° C. The lower limit of the heating temperature is defined to be at least the $Ac_3$ transformation temperature because solution treatment becomes insufficient and ensuring the internal sensible heat for recuperation working becomes difficult when the heating temperature is less than the $AC_3$ transformation temperature.

Figure 3:
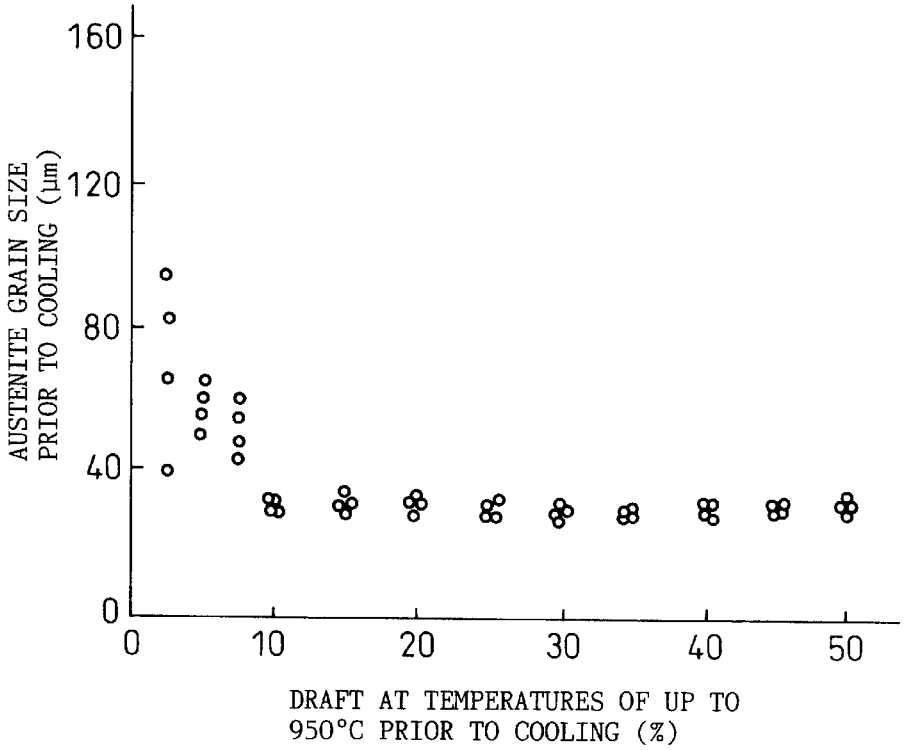
FIG. 3 is a graph showing the relationship between a draft of a steel at temperatures up to 950° C. prior to cooling and an austenite grain size of the steel.
Figure 4:
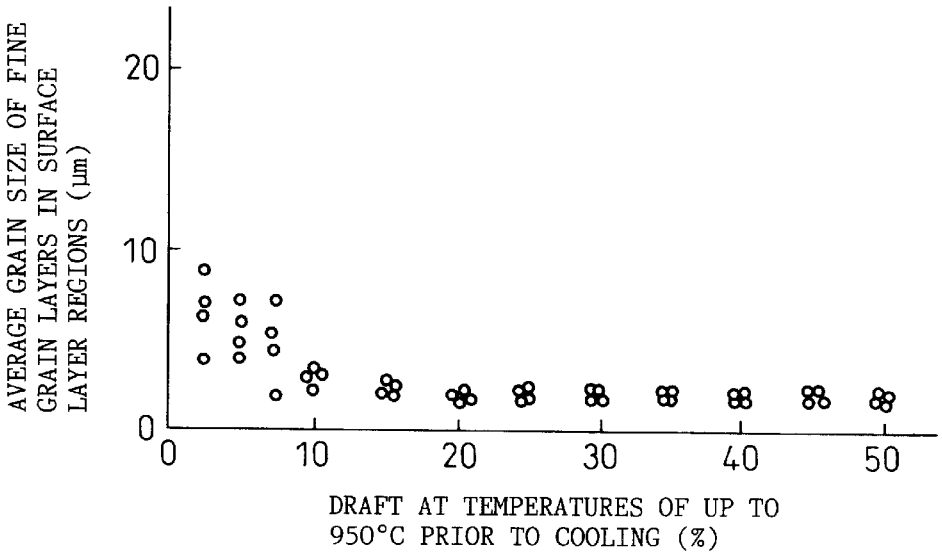
FIG. 4 is a graph showing the relationship between a draft of a steel at temperatures up to 950° C. prior to cooling and an average grain size of fine grain layers in the surface layer regions.
Figure 5:
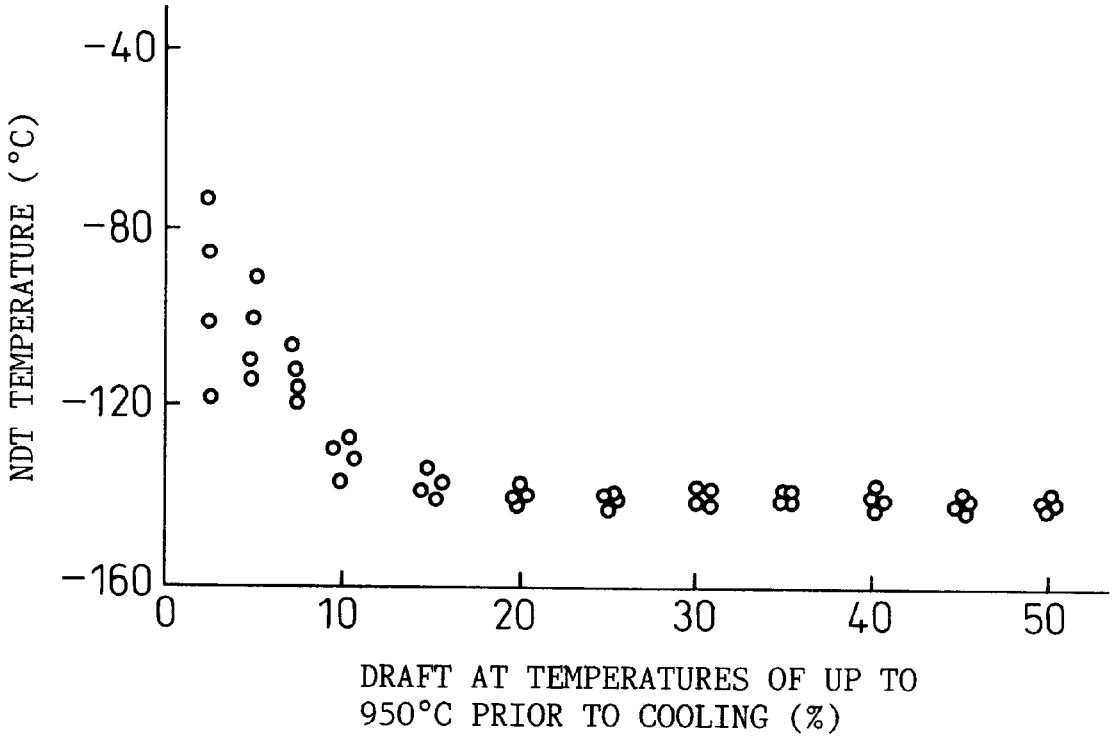
FIG. 5 is a graph showing the relationship between a draft of a steel at temperatures up to 950° C. prior to cooling and a NDT temperature.

There were investigated the cumulative draft at temperatures up to 950° C, the austenite grain size prior to cooling, and the average grain size of the fine grain regions in the surface layer regions and fracture-resistant properties evaluated by NRL drop test after rolling again subsequent to cooling while the working conditions subsequent to cooling were maintained constant. Each of the tests were repeated at least twice, and the distributions of the tests were examined at the same time. The results are shown in FIG. 3 to FIG. 5. FIG. 3 shows the relationship between a draft (%) at 950° C. prior to cooling and an austenite grain size ($\mu$m). FIG. 4 shows the relationship between the draft (%) and an average grain size ($\mu$m) of fine grain layers in the surface layer regions. FIG. 5 shows the relationship between the draft (%) and a NDT temperature (°C.). It has been found that the cumulative draft of from 10 to 50% at temperatures up to 950° C. is best suited to grain refining. The draft at temperatures up to 950° C. is defined because the effects of the draft on the recrystallized austenite grain size and the effects of accumulating strain in non-recrystallized austenite grains become significant by hot rolling at temperatures up to 950° C. When the draft at temperatures up to 950° C. is less than 10%, the effects of rolling become insufficient, and the distribution of the grain size becomes large. The production technique thus becomes unstable. Accordingly, the lower limit of the draft is defined to be 10%.

A further increase in the draft is advantageous to make the structure fine prior to recuperation working. However, when the draft is excessively large, it may sometimes become impossible to ensure a draft sufficient for making ferrite fine in the subsequent rolling during recuperation. The maximum cumulative draft appropriate for making the final surface layer region structure fine has been determined to be 50% on the basis of fundamental experiments.

Next, the effects of working during recuperation on the structure formation will be explained.

When a steel slab is hot rolled by the following procedures: the surface layer regions of the steel slab each having a suitable thickness are cooled once during hot rolling or in the course of hot rolling by means such as water cooling to temperatures lower than the $Ar_3$ transformation temperature, so that there is produced a temperature difference between the surface layer regions and the internal portion, and the steel slab is further hot rolled while having the temperature difference, the surface layer regions having a structure mainly containing ferrite are worked while being recuperated with internal sensible heat. The ferrite grains in the surface layer regions are then made significantly fine by making the working conditions appropriate during the recuperation. Furthermore, since the steel slab is rolled while the surface layer regions have lower temperatures than the internal portion, the internal portion has a lower deformation resistance than the surface layer regions. Accordingly, the effects of effective working are exerted more on the internal portion compared with the case in which a steel slab having a uniform temperature distribution is rolled. As a result, the structure of the internal portion subsequent to transformation also becomes fine. The steel plate consequently exhibits a significantly improved low temperature toughness at the central portion as well as significantly improved brittle crack propagation arrest characteristics.

The present inventors have analyzed in detail the relationship between the structure characteristics of very fine ferrite structure layers formed in the surface layer regions by the production process mentioned above and the brittle crack propagation arrest characteristics. As a result, in order for the steel plate to stably form a shear rip without brittle fracture in the surface layer regions at the time of brittle crack propagation and have good brittle crack propagation arrest characteristics under any fracture conditions, it is required that the ferrite structure in the front surface layer region and the back surface layer region each having a thickness corresponding to 2 to 33% of the plate thickness after recuperation working become ultrafine grains having the grain boundary characteristics mentioned above. In order to meet the requirement, the present inventors have found that it is necessary to make heating and rolling conditions prior to cooling the surface layer regions to temperatures up to the $Ar_3$ transformation temperature appropriate.

Next, reasons for restricting the cooling conditions subsequent to rough rolling will be explained.

After making the austenite grains sufficiently fine and rolling in the non-recrystallization region under the conditions mentioned above, the front surface layer region and the back surface layer region of the plate are cooled by a means such as water cooling. The front surface layer region and the back surface layer region each having a thickness corresponding to 2 to 33% of the thickness of the steel plate at the time of hot rolling prior to water cooling are cooled to temperatures up to the $Ar_3$ transformation temperature, and the steel plate is made to have a temperature difference between the surface layer regions and the internal portion at the same time. The front surface layer region and the back surface layer region each having a thickness corresponding to 2 to 33% of the thickness of the steel plate at the time of hot rolling prior to water cooling are required to be cooled at a rate of at least 2° C./sec. The requirement is based on the grounds that when the cooling rate is less than 2° C./sec, the transformed structure subsequent to cooling becomes coarse even if the austenite is made fine by hot rolling prior to cooling, and a uniform ultrafine ferrite structure becomes difficult to obtain by rolling during recuperation subsequent to cooling.

The structure fraction and draft during rolling have been defined on the grounds as described below.

When the deformation resistances of austenite and ferrite are measured during rolling a steel plate, austenite shows a higher resistance. Basic experiments were, therefore, carried out at the same temperature but in which the fractions of austenite and ferrite were altered. It is concluded from the experimental results that the ferrite grains are more stably made ultrafine when austenite is present. It is seen from the results that making ferrite grains ultrafine becomes significant when the austenite fraction is less than 50%. Moreover, it is found that the ferrite grains are then stably made ultrafine when the draft is at least 30%. The austenite at this time is satisfactory regardless of whether it is nontransformed austenite which remains after cooling and before finish rolling or austenite formed by reverse transformation after cooling. The high deformation resistance of austenite compared with ferrite is thought to be due to the enrichment of alloy elements, etc.

There have been described above reasons for restriction in the process for producing a steel plate wherein the structure of the front surface layer region and the back surface layer region each having a thickness corresponding to 2 to 23% of the plate thickness is made significantly fine. According to the production process, highly toughening the steel plate becomes possible simultaneously in the internal portion thereof as well as in the surface layer regions. That is, when cooling the front surface layer region and the back surface layer region each having a thickness corresponding to 2 to 33% of the steel plate is started from a temperature of at least the $Ar_3$ transformation temperature at a rate of at least 2° C./sec and cooling is stopped at temperatures up to the $Ar_3$ transformation temperature so that the surface layer regions recuperate, the surface layer regions come to have a larger deformation resistance because they have a low temperature compared with the internal portion and a fine grain size. When the steel plate is rolled in such a condition, the internal portion having a lower deformation resistance suffers a larger strain. As a result, the ferrite structure subsequent to transformation becomes more fine, and at the same time pressure bonding center porosities by rolling becomes easy. Consequently, the toughness in the internal portion is significantly improved.

Next, reasons for restricting the thickness of the surface layer regions where grains are made ultrafine will be described.

It can be concluded from the crack propagation behavior in brittle fracture that the steel plate exhibits insufficient energy absorption effects by a shear rip and substantial improvement of the brittle crack propagation arrest characteristics cannot be achieved unless the structure-modified layers in the respective front and back surface layer regions each have a thickness of at least 2% of the plate thickness. Although the brittle crack propagation arrest characteristics are more improved when the fine grain portions of the respective surface layer regions become thicker, the effects are saturated when the thickness exceeds 33%. Moreover, when the steel plate is cooled under such conditions that the thickness of each of fine grain portions of the respective surface layer regions exceeds 33% of the plate thickness in the case in which recuperation is effected by utilizing sensible heat in the internal portion of the steel plate, the sensible heat of the steel plate itself is lost. Consequently, the temperature of the central part in the thickness direction of the steel plate is overly lowered, and the toughness is deteriorated. Accordingly, the thickness of the respective front surface layer and back surface layer regions to be subjected to grain refining corresponding to 3 to 33% of the plate thickness is appropriate as a thickness range for satisfying both the improvement of the brittle crack propagation arrest characteristics of the plate and the toughness of the central part in the thickness direction thereof.

The reasons for restriction of the present invention are as described above, and the desired structure can be obtained at the stage where rolling and recuperation are completed. Cooling subsequent to completion of recuperation may be conducted through means such as allowing the steel to cool or forcible cooling to obtain the desired brittle crack propagation arrest characteristics and toughness. However, in some applications, for example, for the improvement of the strength, the steel plate subsequent to completion of recuperation may also be cooled to up to 650° C. at a rate up to 60° C./sec, or the steel plate may further be tempered at temperatures up to $Ac_1$ transformation temperature after cooling to up to 650° C. at a rate up to 60° C./sec.

Although the present invention is outlined above, factors other than the grain boundaries also influence the brittle crack propagation arrest characteristics and low temperature toughness. It is, therefore, necessary to pay attention to the chemical compositions. Reasons for restricting the chemical compositions will be explained.

Though C is an element effective in ensuring the strength of the steel plate, excessive addition thereof deteriorates the toughness and weldability. Accordingly, the content of C is defined to be from 0.04 to 0.30%.

Although Si is an element necessary for deoxidation, excessive addition thereof particularly deteriorates the toughness of a weld zone. Accordingly, the upper limit of the Si content is defined to be 0.5%.

Although Mn is added to improve the strength and toughness of the steel plate, weld cracks tend to be formed when Mn is excessively added. Accordingly, the Mn content is defined to be up to 2.0%.

Al is similar to Si in that Al is necessary for deoxidation. Al contributes to the improvement of the toughness by grain refining through AlN formation. However, excessive addition thereof deteriorates the toughness and tends to increase the inclusions in the steel. Accordingly, the Al content is defined to be up to 0.1%.

Ti contributes, as TiN, to the improvement of the toughness of the steel plate as a whole through making heated austenite grains fine, and is also an element effective in making the structure of the surface layer regions prior to recuperation fine as described later, the fine structure formation being necessary for stably and uniformly obtaining a fine structure of the surface layer regions. When the addition amount of Ti is less than 0.001%, the effects of making the austenite grains fine are small. When the addition amount of Ti exceeds 0.10%, the effects of Ti are saturated, and TiN thus formed becomes coarse. As a result, the toughness of the steel plate might be deteriorated. Accordingly, the content of Ti is preferably from 0.001 to 0.10%.

Since N forms nitrides with Al and Ti, a suitable content of N is necessary. However, excessive addition of N increases dissolved N to deteriorate the toughness. Accordingly, the appropriate content of N is defined to be from 0.001 to 0.01%.

Cr, Ni, Mo, V, Nb, B and Cu are all effective in increasing the strength of the base steel. To obtain the desired strength, one or at least two of these elements in combination may be added in suitable amounts. Since excessive addition of these elements deteriorates the toughness, weldability and toughness in a weld zone, the upper limits of the contents of these elements are defined.

A steel slab having a restricted chemical composition as mentioned above and the balance Fe and unavoidable impurities is heated to a temperature of at least the $Ac_3$ transformation temperature and up to 1,150° C., and rolled at a temperature up to 950° C. so that the cumulative draft becomes from 10 to 50%. Thereafter, cooling the front layer region and the back layer region each having a thickness corresponding to 2 to 33% of the plate thickness at this stage is started from temperatures of at least $Ar_3$ transformation temperature at a rate of at least 2° C./sec, and stopped at temperatures up to $Ar_3$ transformation temperature so that the surface layer regions are recuperated. In the course of carrying out a cooling and recuperating procedure at least once, the steel plate with a structure having a reversely transformed or nontransformed austenite fraction of less than 50% is rolled at a draft of at least 30% during the period from completion of the final cooling to the end of the recuperation to complete hot rolling. A steel plate excellent in brittle crack propagation characteristics and low temperature toughness can be produced by recuperating the front surface layer region and the back surface layer region of the steel plate subsequent to completion of the rolling to temperatures of less than $AC_3$ transformation temperature.

The present invention will be explained more in detail by making reference to examples.

EXAMPLES

Steel plates were produced by using sample steels having chemical compositions as shown in Table 1 under the conditions as shown in Tables 2 and 3. Table 4 shows the toughness (fracture appearance transition temperature vTrs) obtained by a Charpy impact test and the brittle crack propagation arrest characteristics (temperature at which the Kca value becomes 600 kgf·mm−3/2) obtained by an ESSO test of the steel plates. Steel Plates No. 21 to No. 35 produced by using Steels No. 1 to No. 12 having the chemical compositions of the present invention by the process according to the present invention exhibited very excellent brittle crack propagation arrest characteristics expressed in terms of Kca at −50° C. of from 550 to 1,400 $kgf \cdot mm^{-3/2}$ as well as excellent toughness expressed in terms of vTrs up to −110° C.

Figure 6:
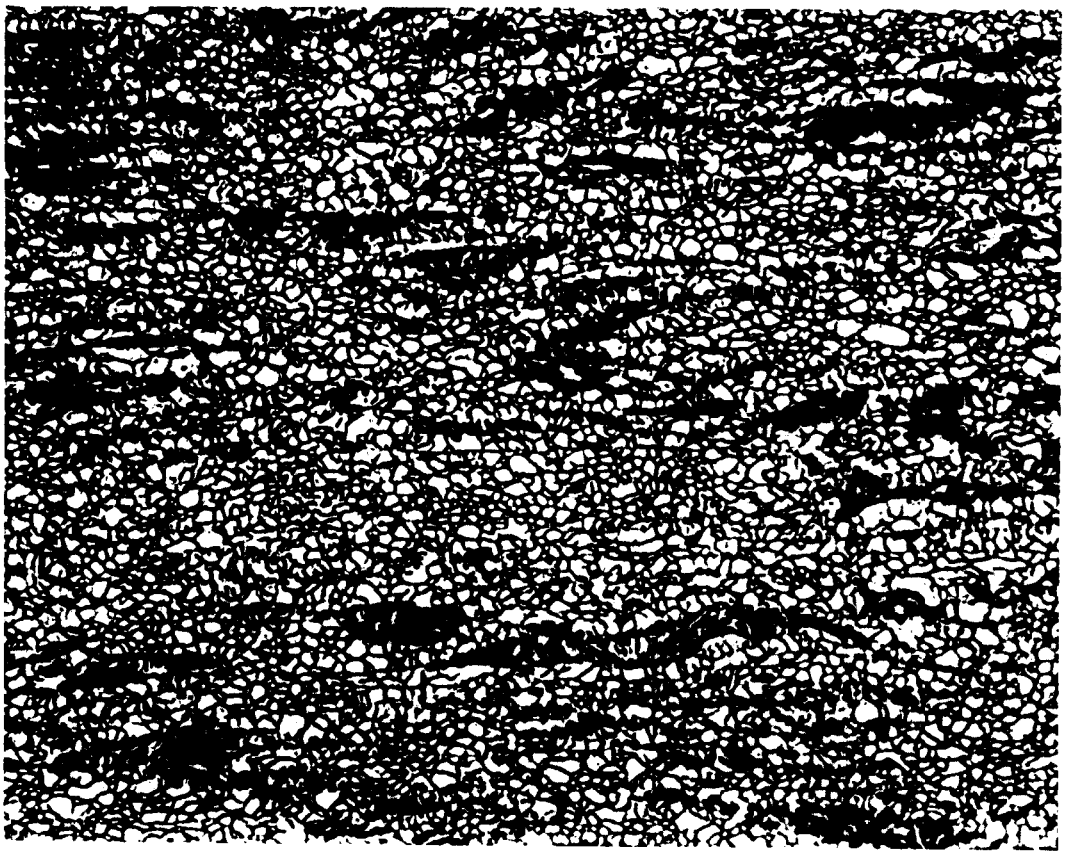
FIG. 6 is a photograph of a metallographic structure of a steel in the present invention, which structure is manifested with a Marshall reagent.

FIG. 6 shows an optical microscopic photograph of a metallographic structure (magnification of 1,000) manifested by a Marshall reagent. It is evident from the typical metallographic structure photograph of an example of the present invention that the ferrite structure of the corresponding portion in the steel of the invention has a grain size up to 3 $\mu$m, and exhibits highly coherent fine grain boundaries.

On the other hand, Steel Plates No. 36 to No. 42 in comparative examples, the chemical compositions of which were outside the scope of the present invention or the production process of which did not agree with that of the present invention, clearly exhibited deteriorated brittle crack propagation arrest characteristics and Charpy characteristics compared with the steel plates produced by the process of the present invention. It is evident from Table 4 that steel plates of Comparative Steels No. 41 and No. 42 which were produced merely by conventional controlled rolling and restricted cooling after rolling naturally did not exhibit satisfactory characteristics, and that steel plates of Comparative Steels No. 36 to No. 40 which were produced by quenching prior to finish rolling and recuperating the surface layer regions and which did not satisfy the other conditions defined by the invention did not exhibit excellent brittle crack propagation arrest characteristics compared with the steels of the present invention.

TABLE 1

| Steel No. | C | Si | Mn | P | S | Cu | Ni | Cr | Mo | Ti | Nb |
|---|---|---|---|---|---|---|---|---|---|---|---|
| 1 | 0.08 | 0.25 | 0.96 | 0.006 | 0.002 | — | — | — | — | 0.012 | — |
| 2 | 0.12 | 0.26 | 1.01 | 0.008 | 0.002 | — | — | — | — | 0.012 | — |
| 3 | 0.15 | 0.26 | 1.00 | 0.006 | 0.003 | — | — | — | — | 0.011 | — |
| 4 | 0.12 | 0.33 | 1.45 | 0.010 | 0.001 | — | — | — | — | 0.013 | — |
| 5 | 0.10 | 0.18 | 1.44 | 0.007 | 0.002 | — | — | — | — | 0.008 | 0.006 |
| 6 | 0.07 | 0.16 | 1.44 | 0.008 | 0.002 | 0.29 | 0.28 | — | — | 0.009 | — |
| 7 | 0.09 | 0.31 | 1.21 | 0.012 | 0.004 | — | — | — | — | 0.008 | — |
| 8 | 0.05 | 0.20 | 1.19 | 0.010 | 0.003 | 0.19 | 0.20 | — | — | 0.007 | — |
| 9 | 0.12 | 0.31 | 0.92 | 0.006 | 0.002 | 0.30 | 0.30 | — | 0.09 | 0.014 | 0.006 |
| 10 | 0.13 | 0.22 | 0.93 | 0.011 | 0.001 | 0.25 | 0.95 | 0.28 | 0.45 | 0.009 | — |
| 11 | 0.09 | 0.20 | 1.17 | 0.015 | 0.002 | 0.33 | 0.61 | 0.08 | 0.06 | 0.016 | 0.040 |
| 12 | 0.13 | 0.41 | 0.76 | 0.009 | 0.003 | 0.51 | 0.50 | 0.25 | 0.25 | 0.007 | 0.015 |
| 13 | 0.13 | 0.30 | 1.22 | 0.009 | 0.003 | — | — | — | — | — | 0.015 |

(mass %)

| Steel No. | V | Al | B | N | Ceq | $Ar_3$ (° C.) | $Ac_3$ (.C) |
|---|---|---|---|---|---|---|---|
| 1 | — | 0.031 | — | 0.0029 | 0.24 | 814 | 856 |
| 2 | — | 0.030 | — | 0.0027 | 0.29 | 800 | 844 |
| 3 | — | 0.028 | — | 0.0031 | 0.32 | 790 | 833 |
| 4 | — | 0.030 | — | 0.0028 | 0.36 | 763 | 835 |
| 5 | — | 0.021 | — | 0.0037 | 0.34 | 770 | 827 |
| 6 | — | 0.029 | — | 0.0031 | 0.35 | 757 | 831 |
| 7 | — | 0.054 | 0.0007 | 0.0033 | 0.29 | 791 | 860 |
| 8 | — | 0.044 | 0.0010 | 0.0040 | 0.27 | 792 | 858 |
| 9 | 0.040 | 0.035 | — | 0.0028 | 0.34 | 776 | 846 |
| 10 | 0.060 | 0.050 | 0.0011 | 0.0049 | 0.52 | 704 | 848 |
| 11 | 0.080 | 0.031 | — | 0.0060 | 0.39 | 748 | 847 |
| 12 | — | 0.033 | 0.0006 | 0.0019 | 0.42 | 753 | 842 |
| 13 | — | 0.049 | — | 0.0044 | 0.33 | 768 | 850 |

Note:
(1) Ceq = C% + Si%/24 + Mn%/6 + (Cu% + Ni%)/15 + (Cr% + Mo% + V%)/5
(2) $Ar_3$ transformation temperature and $Ac_3$ transformation temperature designate transformation temperatures measured by a hot working-reproducing apparatus.

TABLE 2

| Class | Test No. | Steel No. | Heating temp. (° C.) | Slab thickness at the time of heating (mm) | Cumulative draft at temp. ≦950° C. by rolling before recuperation (%) | Steel thickness after rolling before recuperation and before starting finish rolling (mm) | Cooling rate of surface layer regions during cooling before recuperation* (° C./sec) |
|---|---|---|---|---|---|---|---|
| Steel of invention | 21 | 1 | 1050 | 250 | 50 | 125 | 5 |
| | 22 | 2 | 1050 | 250 | 50 | 125 | 5 |
| | 23 | 3 | 1050 | 250 | 50 | 125 | 5 |
| | 24 | 4 | 1050 | 250 | 50 | 125 | 4 |
| | 25 | 5 | 1050 | 250 | 30 | 175 | 3 |
| | 26 | 6 | 1100 | 250 | 30 | 175 | 3 |
| | 27 | 7 | 1000 | 150 | 17 | 125 | 4 |
| | 28 | 8 | 1000 | 150 | 17 | 125 | 4 |
| | 29 | 9 | 1150 | 150 | 17 | 125 | 4 |
| | 30 | 10 | 1050 | 150 | 33 | 100 | 6 |
| | 31 | 11 | 1050 | 150 | 33 | 100 | 6 |
| | 32 | 12 | 1050 | 150 | 33 | 100 | 6 |
| | 33 | 5 | 1070 | 250 | 20 | 200 | 8 |
| | 34 | 5 | 1070 | 250 | 20 | 200 | 8 |
| | 35 | 5 | 1070 | 250 | 20 | 200 | 8 |
| Comp. steel | 36 | 13 | 1100 | 250 | 20 | 200 | 8 |
| | 37 | 13 | 1250 | 250 | 20 | 200 | 8 |
| | 38 | 5 | 1050 | 250 | 30 | 175 | 3 |
| | 39 | 5 | 1050 | 250 | 0 | 250 | 6 |
| | 40 | 5 | 1050 | 250 | 5 | 238 | 6 |
| | 41 | 5 | 1050 | 150 | 50 | 75 | Air cooling |
| | 42 | 7 | 1050 | 150 | 50 | 75 | Air cooling |

| Class | Test No. | Steel No. | Number of cooling from temp. >$Ar_3$ to temp. <$Ar_3$ and then recuperating steel | Finish rolling starting temp. during final recuperation# (° C.) | Draft with austenite fraction <50%** (%) | Temp. at completion of finish rolling during final recuperation# (° C.) |
|---|---|---|---|---|---|---|
| Steel of invention | 21 | 1 | 1 | 750 | 35 | 810 |
| | 22 | 2 | 1 | 735 | 40 | 815 |
| | 23 | 3 | 1 | 750 | 50 | 795 |
| | 24 | 4 | 1 | 775 | 45 | 780 |
| | 25 | 5 | 2 | 720 | 60 | 785 |
| | 26 | 6 | 2 | 780 | 50 | 760 |
| | 27 | 7 | 2 | 770 | 65 | 770 |
| | 28 | 8 | 1 | 660 | 80 | 745 |
| | 29 | 9 | 1 | 685 | 70 | 740 |
| | 30 | 10 | 1 | 680 | 80 | 720 |
| | 31 | 11 | 1 | 715 | 75 | 775 |
| | 32 | 12 | 1 | 710 | 70 | 740 |
| | 33 | 5 | 2 | 690 | 65 | 765 |
| | 34 | 5 | 2 | 740 | 60 | 790 |
| | 35 | 5 | 2 | 770 | 65 | 825 |
| Comp. steel | 36 | 13 | 1 | 780 | 35 | 780 |
| | 37 | 13 | 1 | 760 | 40 | 765 |
| | 38 | 5 | 2 | 780 | 25 | 870 |
| | 39 | 5 | 1 | 690 | 45 | 800 |
| | 40 | 5 | 1 | 720 | 70 | 770 |
| | 41 | 5 | 0 | 820 | 0 | 800 |
| | 42 | 7 | 0 | 790 | 0 | 790 |

Note:

*An average cooling rate of the steel plate from the start of cooling to the lowest temperature at the portion of the front surface layer and the back surface layer regions cooled and recuperated which portion exhibited the lowest cooling rate (estimated value).

#The temperature at about the central parts in the respective front and back surface layer regions cooled and recuperated (value estimated from the surface temperature).

**The draft is one which was imparted to the steel while the reversely transformed or nontransformed austenite fraction was less than 50%.

TABLE 3

| Class | Test No. | Steel No. | Finished plate thickness (mm) | Cooling conditions after completion of finish rolling* Cooling rate (° C./sec) | Cooling stop temp. (° C.) | Tempering conditions Heating temp. (° C.) | Holding time (min) |
|---|---|---|---|---|---|---|---|
| Steel of inven-tion | 21 | 1 | 18 | Air cooling | — | — | — |
| | 22 | 2 | 22 | Air cooling | — | — | — |
| | 23 | 3 | 20 | Air cooling | — | — | — |
| | 24 | 4 | 19 | Air cooling | — | — | — |
| | 25 | 5 | 28 | 20 | 605 | — | — |
| | 26 | 6 | 30 | 20 | 595 | — | — |
| | 27 | 7 | 25 | 20 | 590 | — | — |
| | 28 | 8 | 30 | 20 | 600 | — | — |
| | 29 | 9 | 25 | 20 | 580 | — | — |
| | 30 | 10 | 25 | 25 | Room temp. | 600 | 30 |
| | 31 | 11 | 25 | 25 | Room temp. | 530 | 30 |
| | 32 | 12 | 25 | 25 | Room temp. | 570 | 30 |
| | 33 | 5 | 50 | 15 | Room temp. | 570 | 60 |
| | 34 | 5 | 55 | 15 | Room temp. | 570 | 60 |
| | 35 | 5 | 60 | 15 | Room temp. | 570 | 60 |
| Comp. steel | 36 | 13 | 50 | 15 | Room temp. | 570 | 60 |
| | 37 | 13 | 50 | 15 | Room temp. | 570 | 60 |
| | 38 | 5 | 55 | 25 | 605 | — | — |
| | 39 | 5 | 55 | 15 | Room temp. | 570 | 60 |
| | 40 | 5 | 50 | 15 | Room temp. | 570 | 60 |
| | 41** | 5 | 25 | 20 | 590 | — | — |
| | 42** | 7 | 25 | 20 | 570 | — | — |

| Class | Test No. | Steel No. | Front and back surface layer regions to be cooled and recuperated of steel plate (proportion to entire thickness) (%) | Average grain size of front and back surface layer regions (μm) | Hv index obtained from expression (1) | Average Hv and back surface layer regions (10 kg) | |
|---|---|---|---|---|---|---|---|
| Steel of in-ven-tion | 21 | 1 | 15 | 2.5 | 189 | 181 | |
| | 22 | 2 | 18 | 2.6 | 205 | 185 | |
| | 23 | 3 | 11 | 2.8 | 212 | 195 | |
| | 24 | 4 | 12 | 1.8 | 262 | 210 | |
| | 25 | 5 | 20 | 1.9 | 246 | 202 | |
| | 26 | 6 | 16 | 2.6 | 226 | 195 | |
| | 27 | 7 | 21 | 2.8 | 203 | 180 | |
| | 28 | 8 | 26 | 2.9 | 192 | 210 | |
| | 29 | 9 | 13 | 2.2 | 234 | 203 | |
| | 30 | 10 | 12 | 2.1 | 285 | 232 | |
| | 31 | 11 | 14 | 2.5 | 234 | 216 | |
| | 32 | 12 | 15 | 2.9 | 232 | 214 | |
| | 33 | 5 | 26 | 2.2 | 235 | 165 | |
| | 34 | 5 | 28 | 2.4 | 229 | 175 | |
| | 35 | 5 | 22 | 1.8 | 250 | 185 | |
| Comp. steel | 36 | 13 | 17 | 3.8 | 200 | 186 | |
| | 37 | 13 | 9 | 3.9 | 198 | 175 | |
| | 38 | 5 | 20 | 4.6 | 190 | 188 | |
| | 39 | 5 | 12 | 5.3 | 183 | 171 | |
| | 40 | 5 | 14 | 7.2 | 170 | 162 | |
| | 41** | 5 | 0 | 16 | 132 | 145 | Conventional controlled rolling |
| | 42** | 7 | 0 | 24 | 122 | 155 | Conventional controlled rolling |

Note:

*The cooling rate is an average cooling rate at the central part in the thickness direction from the start of cooling to 400° C. (estimated value). The cooling stop temperature was measured on the surface of the plate.

**Since Comparative steels No. 41 and No. 42 had no recuperation step, each of the temperatures in the table designates a temperature in a simple cooling step.

TABLE 4

| Class | Test No. | Steel No. | YP ($N/mm^2$) | TS ($N/mm^2$) | vTrs in central part (in L direction) (° C.) | Temp. showing Kca = 600 $kgf.mm^{-3/2}$ by ESSO test (° C.) (in L direction) |
|---|---|---|---|---|---|---|
| Steel of invention | 21 | 1 | 351 | 417 | −117 | −126 |
| | 22 | 2 | 379 | 470 | −120 | −115 |
| | 23 | 3 | 428 | 511 | −125 | −109 |
| | 24 | 4 | 469 | 548 | −135 | −116 |
| | 25 | 5 | 442 | 545 | −125 | −121 |
| | 26 | 6 | 475 | 555 | −135 | −125 |
| | 27 | 7 | 414 | 490 | −120 | −110 |
| | 28 | 8 | 383 | 450 | −122 | −103 |
| | 29 | 9 | 493 | 590 | −125 | −105 |
| | 30 | 10 | 607 | 710 | −120 | −105 |
| | 31 | 11 | 569 | 680 | −115 | −100 |
| | 32 | 12 | 551 | 652 | −120 | −90 |
| | 33 | 5 | 440 | 556 | −115 | −105 |
| | 34 | 5 | 445 | 560 | −110 | −106 |
| | 35 | 5 | 443 | 559 | −120 | −113 |
| Comp. steel | 36 | 13 | 480 | 575 | −96 | −72 |
| | 37 | 13 | 488 | 580 | −107 | −65 |
| | 38 | 5 | 450 | 564 | −95 | −70 |
| | 39 | 5 | 446 | 560 | −116 | −50 |
| | 40 | 5 | 449 | 565 | −108 | −57 |
| | 41 | 5 | 418 | 495 | −45 | −19 |
| | 42 | 7 | 422 | 502 | −57 | −5 |

POSSIBILITY OF UTILIZATION IN THE INDUSTRY

The present invention stably achieves an improvement in brittle crack propagation arrest characteristics of steel plates by a novel production process which improvement can conventionally be obtained only by addition of a large amount of Ni. The process of the present invention can produce steel plates for structures with high safety without impairing economic advantage and productivity, and the effects of the process on the industry are extremely significant.

What is claimed is:

1. A steel plate excellent in brittle crack propagation arrest properties and low temperature toughness comprising, based on weight, 0.04 to 0.30% of C, up to 0.5% of Si, up to 2.0% of Mn, up to 0.1% of Al, 0.001 to 0.10% of Ti, 0.001 to 0.01% of N and the balance Fe and unavoidable impurities, the average grain size d of the structure in the front surface layer region and the back surface layer region each having a thickness corresponding from 2 to 33% of the plate thickness being up to 3 $\mu$m, and the Vickers hardness of the structure satisfying the following expression (1):

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn % are percent by weight of C, Si and Mn, respectively).

2. A steel plate excellent in brittle crack propagation arrest properties and low temperature toughness comprising, based on weight, 0.04 to 0.30% of C, up to 0.5% of Si, up to 2.0% of Mn, up to 0.1% of Al, 0.001 to 0.10% of Ti, 0.001 to 0.01% of N, one or at least two elements selected from the following group in the following contents: up to 0.5% of Cr, up to 1.0% of Ni, up to 0.5% of Mo, up to 0.1% of V, up to 0.05% of Nb, up to 0.0015% of B and up to 1.5% of Cu, and the balance Fe and unavoidable impurities, the average grain size d of the structure in the front surface layer region and the back surface layer region each having a thickness corresponding from 2 to 33% of the plate thickness being up to 3 $\mu$m, and the Vickers hardness of said structure satisfying the following expression (2):

$$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

3. A process for producing a steel plate excellent brittle crack propagation arrest properties and low temperature toughness comprising the steps of heating a steel slab comprising, based on weight, 0.04 to 0.30% of C, up to 0.5% of Si, up to 2.0% of Mn, up to 0.1% of Al, 0.001 to 0.10% of Ti, 0.001 to 0.01% of N and the balance Fe and unavoidable impurities to a temperature of at least the $Ac_3$ transformation temperature and up to 1,150° C., rolling the heated slab so that the cumulative draft at temperatures up to 950° C. becomes from 10 to 50%, carrying out at least once a procedure comprising starting cooling the front surface layer region and the back surface layer region each having a thickness corresponding to 2 to 33% of the plate thickness at this stage at a rate of at least 2° C./sec from temperature of at least the $Ar_3$ transformation temperature, and stopping cooling at a temperature of up to the $Ar_3$ transformation temperature so that the steel plate recuperates, finishing finish rolling during the period from the completion of the final cooling to the end of the recuperation in the above step by rolling the steel plate so that at least 30% of a draft is imparted thereto while the structure of the steel plate contains reversely transformed or non-transformed austenite in a fraction of less than 50%, recuperating the front and the back surface layer regions of the thus finish rolled steel plate to temperatures of less than the $Ac_3$ transformation temperature, and cooling the steel plate, the average grain size d of the structure in the front surface layer region and the back surface layer region each having a thickness corresponding to 2 to 33% of the resulting steel plate being up to 3 $\mu$m, and the Vickers hardness of the structure satisfying the following expression (1):

$$Hv \leqq 200[Ceq\ \%]+20+(9[Ceq\ \%]+3.7)/\sqrt{(d)} \quad (1)$$

wherein [Ceq %]=C %+Si %/24+Mn %/6 (wherein C %, Si % and Mn % percent by weight of C, Si and Mn, respectively).

4. A process for producing a steel plate excellent in brittle crack propagation arrest properties and low temperature toughness comprising the steps of heating a steel slab comprising, based on weight, 0.04 to 0.30% of C, up to 0.5% of Si, up to 2.0% of Mn, up to 0.1% of Al, 0.001 to 0.10% of Ti, 0.001 to 0.01% of N, one or at least two elements selected from the following group in the following contents: up to 0.5% of Cr, up to 1.0% of Ni, up to 0.5% of Mo, up to 0.1% of V, up to 0.05% of Nb, up to 0.0015% of B and up to 1.5% of Cu, and the balance Fe and unavoidable impurities to temperatures of at least $AC_3$ transformation temperature and up to 1,150° C., rolling the heated slab so that the cumulative draft at temperatures up to 950° C. becomes from 10 to 50%, carrying out at least once a procedure comprising starting cooling the front surface layer region and the back surface layer region each having a thickness corresponding to 2 to 33% of the plate thickness at this stage at a rate of at least 2° C./sec from temperature of at least the $Ar_3$ transformation temperature, and stopping cooling at temperatures up to the $Ar_3$ transformation temperature so that the steel plate recuperates, finishing finish rolling during the period from the completion of the final cooling to the end of the recuperation in the above step by rolling the steel plate so that at least 30% of a draft is imparted thereto while the structure of the steel plate contains reversely transformed or non-transformed austenite in a fraction of less than 50%, recuperating the front and the back surface layer regions of the thus finish rolled steel plate to temperatures of less than $Ac_3$ transformation temperature, and cooling the steel plate, the average grain size d of the structure in the front surface layer region and the back surface layer region each having a thickness corresponding to 2 to 33% of the resulting steel plate being up to 3 $\mu$m, and the Vickers hardness of the structure satisfying the following expression (1):

$$Hv \leqq 200[Ceq\ \%]+20+(9[Ceq\ \%]+3.7)/\sqrt{(d)} \quad (2)$$

wherein [Ceq %]=C %+Si %/24+Mn %/6+(Cu %+Ni %)/15+(Cr %+Mo %+V %)/5 (wherein C %, Si %, Mn %, Cu %, Ni %, Cr %, Mo % and V % are percent by weight of C, Si, Mn, Cu, Ni, Cr, Mo and V, respectively).

5. The process for producing a steel plate excellent in brittle crack propagation arrest properties and low temperature toughness according to claim 3, wherein the steel plate whose front and back surface layer regions have been recuperated to temperatures of less than the $Ac_3$ transformation temperature subsequent to completion of the finish rolling is cooled to temperatures up to 650° C. at a rate up to 60° C./sec.

6. The process for producing a steel plate excellent in brittle crack propagation arrest properties and low temperature toughness according to claim 3, wherein the steel plate whose front and back surface layer regions have been recuperated to temperatures of less than the $Ac_3$ transformation temperature subsequent to completion of the finish rolling is cooled to a temperature up to 650° C. at a rate up to 60° C./sec, and the steel plate is tempered at a temperature up to the $Ac_1$ transformation temperature.

* * * * *